United States Patent [19]

Dieling et al.

[11] 4,046,080

[45] Sept. 6, 1977

[54] MOTORIZED SWIVELING STREETCAR TRUCKS

[75] Inventors: Hans Dieling, Rhunda; Manfred Schindehütte, Calden, both of Germany

[73] Assignee: Wegmann & Co., Kassel, Germany

[21] Appl. No.: 559,456

[22] Filed: Mar. 18, 1975

Related U.S. Application Data

[63] Continuation-in-part of Ser. No. 496,243, Aug. 9, 1974, abandoned, which is a continuation of Ser. No. 368,379, June 8, 1973, Pat. No. 3,830,166.

[51] Int. Cl.[2] ..... B61C 3/00; B61C 15/00; B61F 3/04; B61F 5/24

[52] U.S. Cl. ..... 105/133; 105/77; 105/182 R; 105/199 R; 105/206 A; 105/224.1

[58] Field of Search ..... 105/77, 131, 133, 135, 105/136, 137, 138, 139, 182 R, 182 E, 192, 197 B, 199 A, 199 C, 199 F, 202, 206 R, 206 A, 208, 208.1, 208.2, 218 A, 224, 199 R, 224.1

[56] References Cited

U.S. PATENT DOCUMENTS

| | | | |
|---|---|---|---|
| 1,875,380 | 9/1932 | Howard et al. | 105/182 R |
| 2,159,814 | 5/1939 | McCune | 105/77 |
| 2,186,008 | 1/1940 | Chapman | 105/206 R |
| 2,231,848 | 2/1941 | Eksergian | 105/206 R |
| 2,336,661 | 12/1943 | Williams | 105/182 R X |
| 2,562,573 | 7/1951 | Piron | 105/182 R |
| 2,955,547 | 10/1960 | Ebenbach | 105/139 |
| 3,022,748 | 2/1962 | Lich | 105/192 |
| 3,200,769 | 8/1965 | Dobson et al. | 105/138 |
| 3,313,245 | 4/1967 | Sundby | 105/206 R X |
| 3,523,505 | 8/1970 | Lich | 105/182 R |
| 3,818,841 | 6/1974 | Julien | 105/182 R |
| 3,830,166 | 8/1974 | Dieling et al. | 105/182 E X |

*Primary Examiner*—Robert J. Spar
*Assistant Examiner*—Howard Beltran
*Attorney, Agent, or Firm*—Burgess, Dinklage & Sprung

[57] ABSTRACT

A motorizable swivel truck for rail vehicles, especially streetcars, having a truck frame on which a cradle frame lying transversely of the direction of travel is supported by at least one coil spring, and the car body rests upon the cradle frame through a support means which permits wide swiveling of the swivel truck. The coil truck frame consists of two longitudinal members having a generally underslung configuration and whose middle portion has a level lower than the level of either end of each longitudinal member. The longitudinal members have end portions which have a closed profile while the middle portion has an open profile. The swivel truck frame comprises two cross members which are disposed between the wheel axles and may also have a cross-sectional open profile. The ends of the cross-sectional members are connected to the longitudinal members suitably by being welded to the same. Owing to the underslung and arched configurations and the specific construction the swivel truck frame is flexible so that the wheel bearings may be mounted with stiff springing of the end portions of the longitudinal members. The device can also have a motor or pair of motors suspended on the cross members in such a manner that the drive shaft of the motors lies parallel to the direction of travel, the driving of the wheel axles being performed through a bevel or spur gear transmission.

8 Claims, 13 Drawing Figures

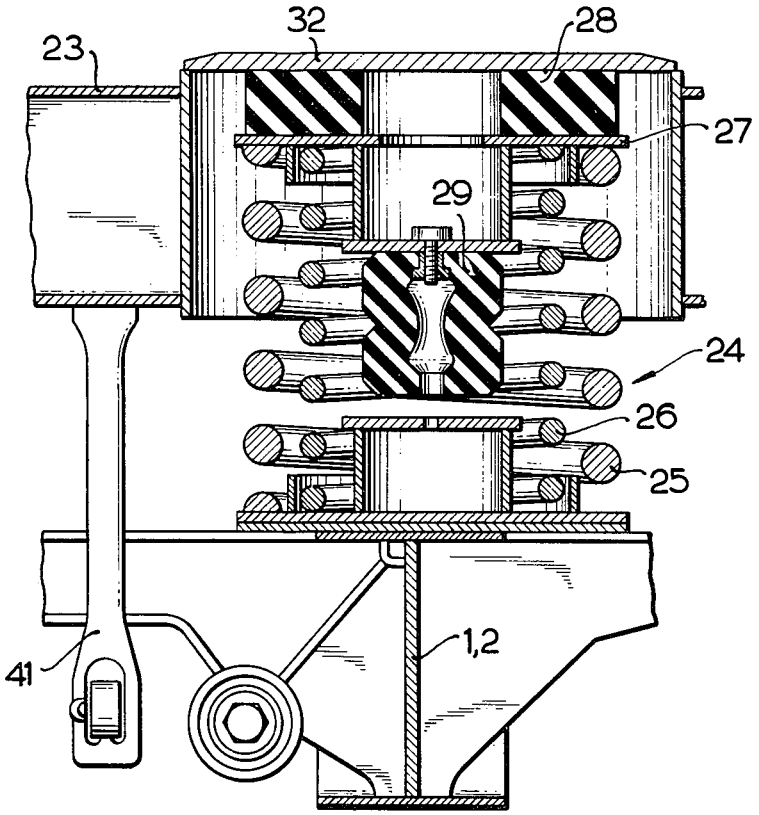
FIG.10
FIG.11
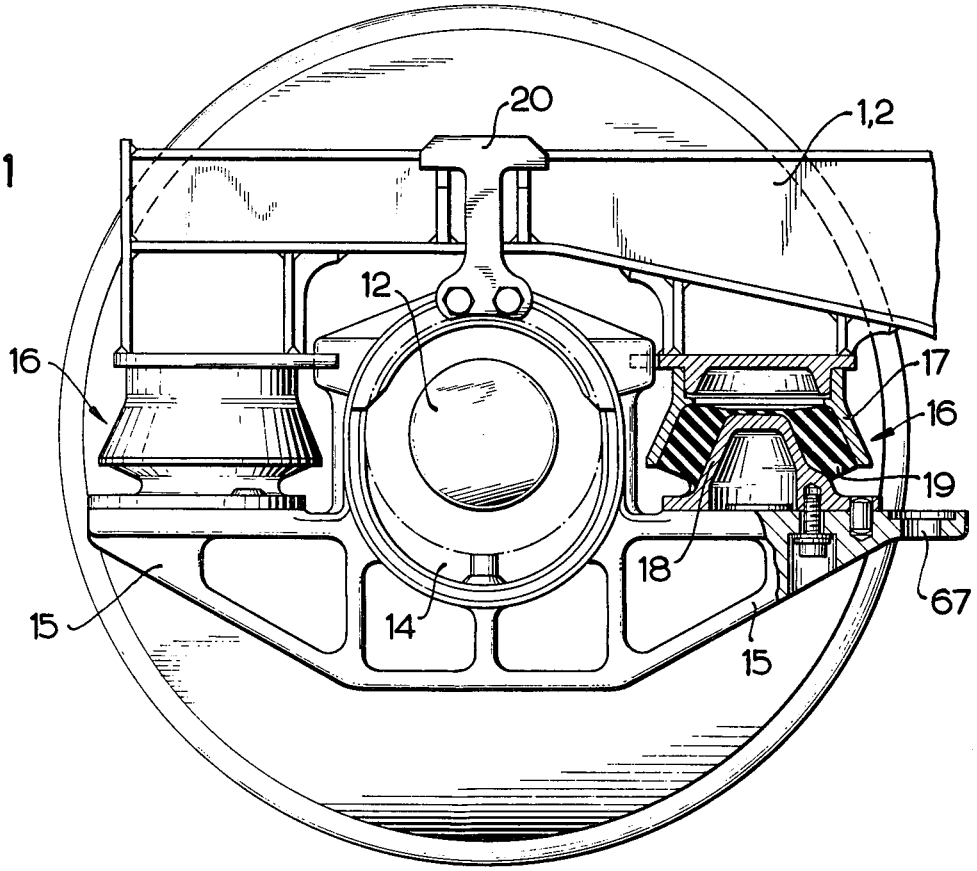

MOTORIZED SWIVELING STREETCAR TRUCKS

CROSS REFERENCE TO RELATED APPLICATION

This is a continuation-in-part of copending application Ser. No. 496,243, filed Aug. 9, 1974, now abandoned, which, in turn is a continuation of Ser. No. 368,379 of June 8, 1973, now Pat. No. 3,830,166.

BACKGROUND OF THE INVENTION

Field of the Invention

This invention relates to a swivel truck for rail vehicles, especially for streetcars, which is capable of pivoting to such an extent that curves of even small radius can be negotiated.

This invention is particularly concerned with a swivel truck for rail vehicles which is flexible, i.e., a truck in which, when one of the wheel axis bearings or one of the contact points between the wheels and the rails is lifted out of the plane of the other three axle bearings or contact points, the contact pressures do not become any higher than is permitted in the case of vehicles having sprung axle bearings.

This invention is particularly directed to a swivel truck for a rail vehicle having a swivel truck frame of longitudinal members and cross members wherein the longitudinal members are of an underslung configuration in a central portion thereof and the cross members are connected to a middle portion thereof as by welding to provide a balancing of the wheel loads within the swivel truck by deformation of the swivel truck frame independently from any spring constants of a springing system therein. The construction of the swivel truck of the present invention permits the entire truck to undergo torsion, i.e., it allows for the situation that if one end of the one of the longitudinal members of the swivel truck frame is lifted up while the other three ends remain constant no great reaction of forces occurs.

This invention further relates to a flexible motor-powered swivel truck in which the motor is resiliently suspended and a resilient torque coupling is inserted into the drive between the motor shaft and the wheel axle. The invention is further directed to a swivel truck in which there is a cradle frame supported on a swivel truck frame by means of at least one coil spring, preferably a pair of coil springs disposed between the swivel truck frame and the cradle frame. Particularly contemplated is a swivel truck wherein a pair of coil springs are employed, each pair of coil springs being provided with an additional supplementary spring of rubber of rubber-elastic material disposed between each of the coil springs and the cradle frame. Especially contemplated is a supplementary spring of rubber or rubber elastic material disposed within each of the coil springs of the spring system.

The invention also relates to a motorized swivel. truck in which the longitudinal truck frame members are of a specific underslung configuration between the points at which the cross-members are welded, and the cross-members are of an arched configuration, the motor being suspended from the cross members and additionally from the longitudinal members.

SUMMARY OF THE INVENTION

Broadly, this invention contemplates a motor powdered swivel truck for rail vehicles, especially for streetcars, comprising a swivel truck frame, a cradle frame, a spring and a sway stabilizing means;

A. Said swivel track frame comprising two longitudinal members, the middle portion of each being disposed at a level below the end portions thereof and having an open profile, a pair of cross members connected to said longitudinal members within the wheel axles to define a quadrangle where the middle portions of the longitudinal members have the lower level, said longitudinal members having an upper flange extending laterally thereof and running longitudinally, said upper flange being bent downwardly, said cross-members having a laterally extending lower flange, the lower flange of said cross members connected to the upper flange of the middle portion of said longitudinal members within said quadrangle by a stiffening sheet;

B. The end portions of said longitudinal members having recesses for receiving wheel bearings; said spring disposed between said swivel truck frame and said cradle frame and comprising a pair of coil springs, one on each side of said truck;

C. Said sway stabilizing means comprising a torsion rod disposed rotatably at said cradle frame, transversally of the direction of travel of said truck, the ends of which are connected to horizontally disposed levers, rigidly mounted, said horizontally disposed levers each having a free end, said free ends each connected to a vertical member, said vertical members connected to said swivel truck frame; and D. Said cradle frame comprising a central receiver for receiving a connector attached to a car body, a pair of electric motors, having output shafts, said motors disposed on said cradle frame such that said output shafts are parallel to the wheel axles, the housings for said motors suspended on one side of a longitudinal member and on the other side supported on a cross member.

BRIEF DESCRIPTION OF DRAWINGS

In order to more fully illustrate the invention reference is made to the accompanying drawings in which:

FIG. 10 shows the spring arrangement on an enlarged scale.

FIG. 11 is an enlarged partial cutaway view of an axle shaft bearing of the swivel frame according to FIG. 1.

DESCRIPTION OF SPECIFIC EMBODIMENTS

Figure 5:
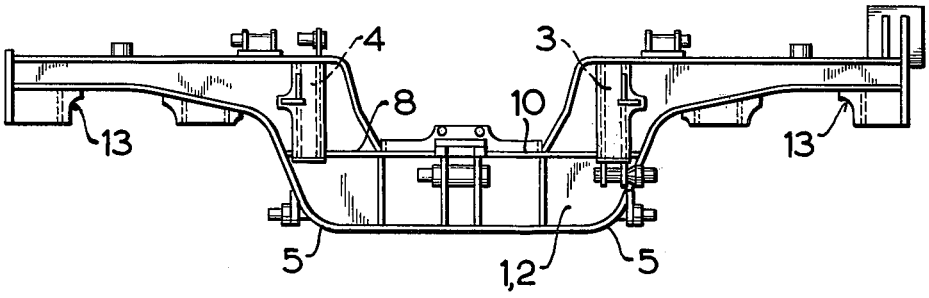
FIG. 5 is a side elevational view of the swivel truck frame according to FIG. 4.
Figure 6:
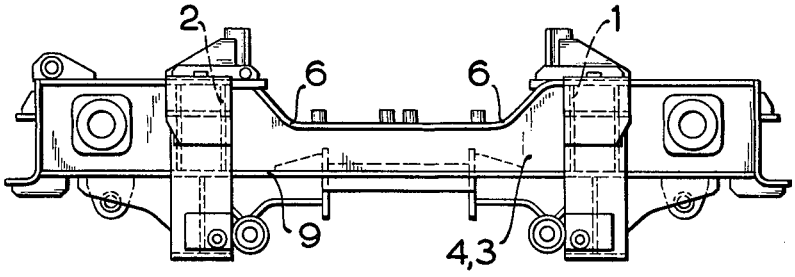
FIG. 6 is a front view of the swivel truck frame according to FIG. 4.

Referring to the drawings appended hereto which show a specific embodiment of the invention, there is shown a swivel truck frame consisting of longitudinal members 1 and 2 and cross members 3 and 4 whose ends are connected to the longitudinal members as by welding. As best seen in FIG. 5, the longitudinal members are of an underslung configuration in their central portion between the points at which the cross members are welded. The longitudinal members are of an open cross section in their middle portion as seen in FIG. 5. A frame member or girder of open cross-section is capable of torsion in contrast to a girder of closed cross-section, i.e., one having a tubular or boxed-shaped cross-section. This is due to the fact that the longitudinal flanges of a frame member having an open cross-section shift longitudinally in relation to one another as the girder is twisted. This shifting may not be restrained because otherwise high material stresses counteracting the twist would arise. The underslung configuration of the longitudinal members establishes the condition that longitudinal movements which occur when the frame member is twisted act upon bent portions 5 without producing excessively great material stresses. The portions of the longitudinal members which extend in the longitudinal direction beyond the welding points of cross members 3 and 4, have, however, (as seen in FIG. 6) a closed profile. By the term "closed profile" it is meant that these cross members are box-shaped so that these sections of the longitudinal frame members are not fundamentally capable of torsion. They do not offer such great resistance that no perceptible twisting can occur.

Referring to the construction of the swivel truck of the invention, the cross members 3 and 4 also have an open profile and are suitably constructed in the manner of I-beams. As is evident from FIG. 6, these cross members the safety cinch or upper cord at 6 is bent downwards. Also at this point the longitudinal movements which occur during the torsion or twisting may act on the bending point 6 so that the cross members are fundamentally capable of torsion without producing unacceptable material stresses at the welds which would tend to prevent a longitudinal displacement of the upper and lower flanges of the longitudinal and cross members respectively.

In the upper portions located outside of the longitudinal members, the profile of the cross members turns into or becomes a torsion rigid box profile inasmuch as at point 7, the flanges of the I profile branch into two flanges. Through this construction of the swivel truck the entire truck is capable of torsion. Thus, if one end of the longitudinal members is lifted up while the other three ends remain at rest no great reaction forces will occur. There will only be experienced forces which are maximally equal to the forces which occur in the axle springing in the rigid swivel trucks when one wheel is lifted. The torsion flexible swivel truck thus provides a balancing of the wheel loads within the swivel truck by deformation of the swivel truck frame, independently from any spring constant of any springing system of the axle bearing. So that this swivel truck which is of a flexible nature may also have the necessary corner stiffness, an arcuate plate 8 is welded into the middle section of the frame, i.e., this plate lies at the same height with the bottom flanges 9 of the cross members and the upper flange 10 of the middle portion of the longitudinal carriers which are bent downwards. The plate is welded with these members into a continuous plate. Through this sheet, without impairing flexibility, the angles between the longitudinal and cross members are established and thus a longitudinal movement of the two longitudinal members in relationship to one another is prevented. The sheet 8 extends laterally somewhat beyond the longitudinal members 1 and 2 and supports the swivel supports to be described below.

The swivel truck frame rests on the two wheel axles 11 and 12. Cutouts 13 are provided in the longitudinal members 1 and 2 for mounting of the wheel axles. One wheel axle mounting is shown in FIG. 11.

The wheel axle bearings, which can best be in the form of ball or roller bearings, are carried by axle bearing housings 14 (FIG. 11), which have two lateral arms 15, on which the longitudinal members 1 and 2 are supported. Between the arms 15 and the longitudinal members 1 and 2, frame support pad assemblies 16 are inserted. Each of these pad assemblies consist of a tapered socket 17, a cone 18 and a resilient bushing 19. These frame support assemblies provide the desired springing in all three directions. They permit slight movements of the axle bearing 14 vertically, longitudinally and transversally in relationship to the longitudinal member. Stated differently, they do not only serve for the spring suspension of the vehicle itself, but also improve the running characteristics of the wheel sets whose axle bearings are capable, by virtue of this spring, of moving slightly longitudinally of the vehicle when the vehicle is negotiating a curve. A safety device 20 assures that the frame will not be able to lift completely away from the wheel axle bearing or that the wheel sets will not drop out if the swivel truck is lifted off of a track as by a crane.

Figure 1:
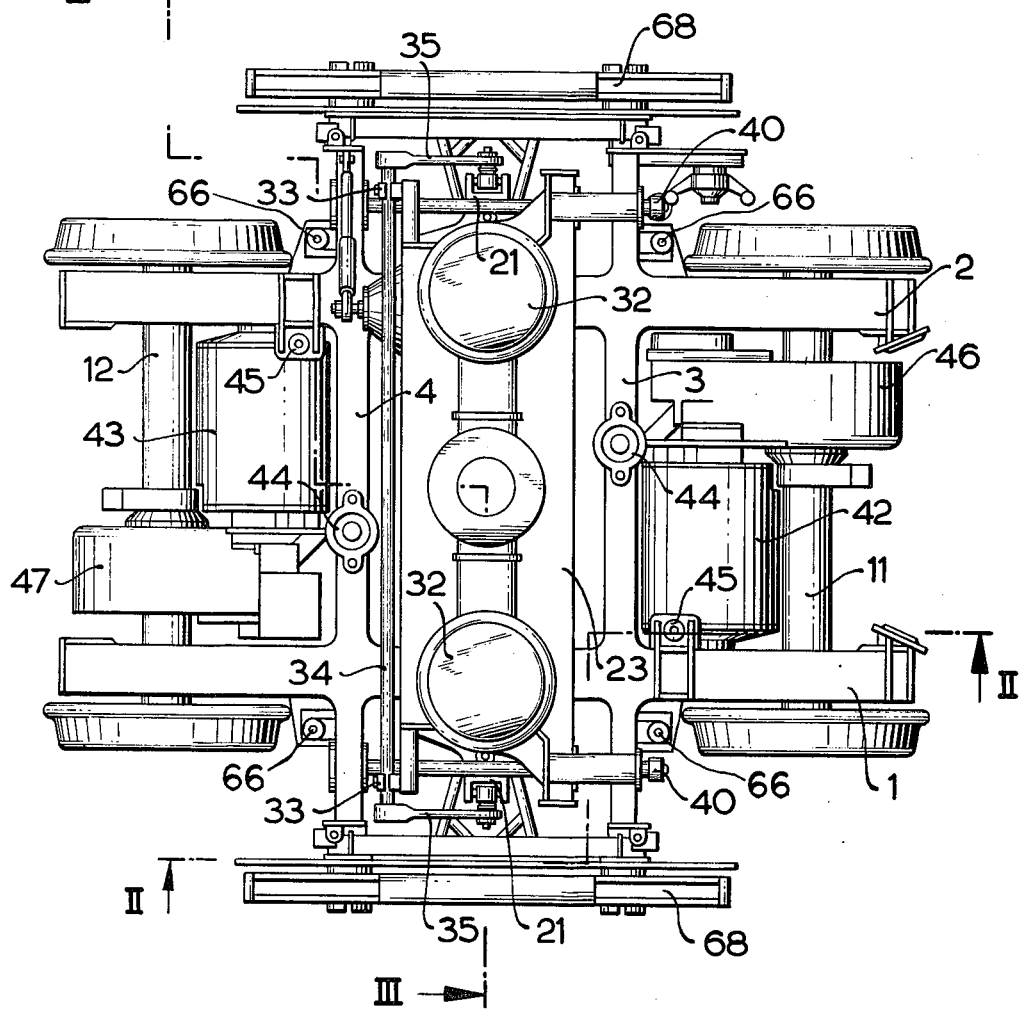
FIG. 1 is a top view of the motorized swivel truck, with the car body removed.
Figure 2:
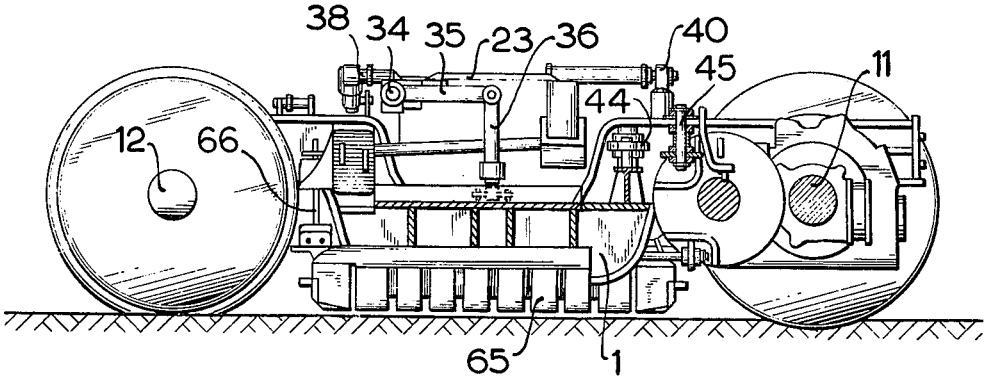
FIG. 2 is a side elevational view of the swivel truck taken along line II–II of FIG. 1.
Figure 3:
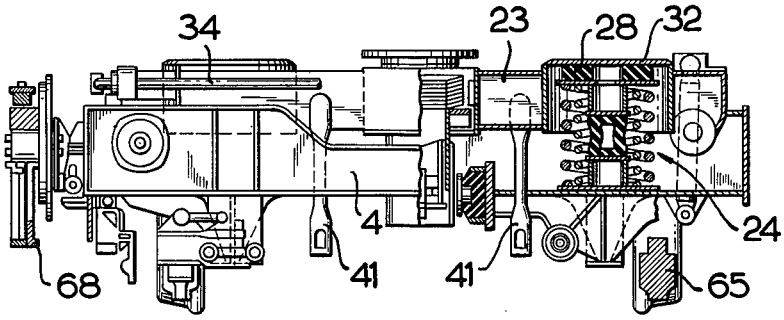
FIG. 3 is a front view of the swivel truck according to FIG. 1 but cut along the line III–III in FIG. 1.
Figure 4:
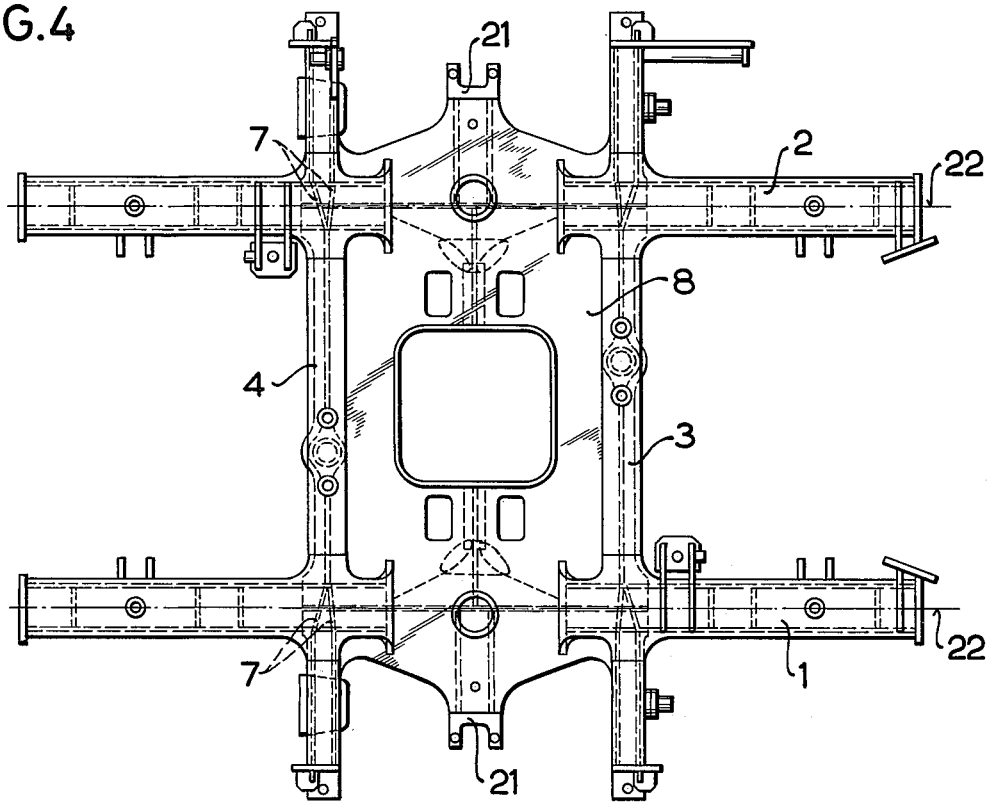
FIG. 4 is a top view of the swivel truck frame of the invention.

As seen in FIGS. 2 and 3, a cradle frame 23 is disposed above the swivel truck frame transversally of the direction of travel. This cradle frame rests by means of two spring systems 24 on the middle portion of the longitudinal members. Preferably, the centers of these spring systems are disposed close to but somewhat outside of the vertical plane 22 passing through the center of the wheel axle bearing. This is seen in FIG. 4.

Figure 9:
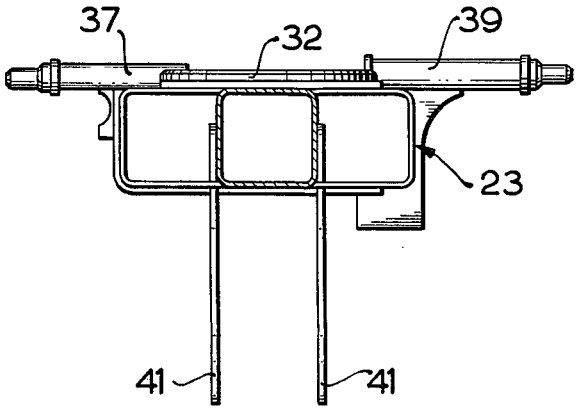
FIG. 9 shows the cradle frame according to FIG. 7 taken along the line IX–IX of FIG. 8.
Figure 7:
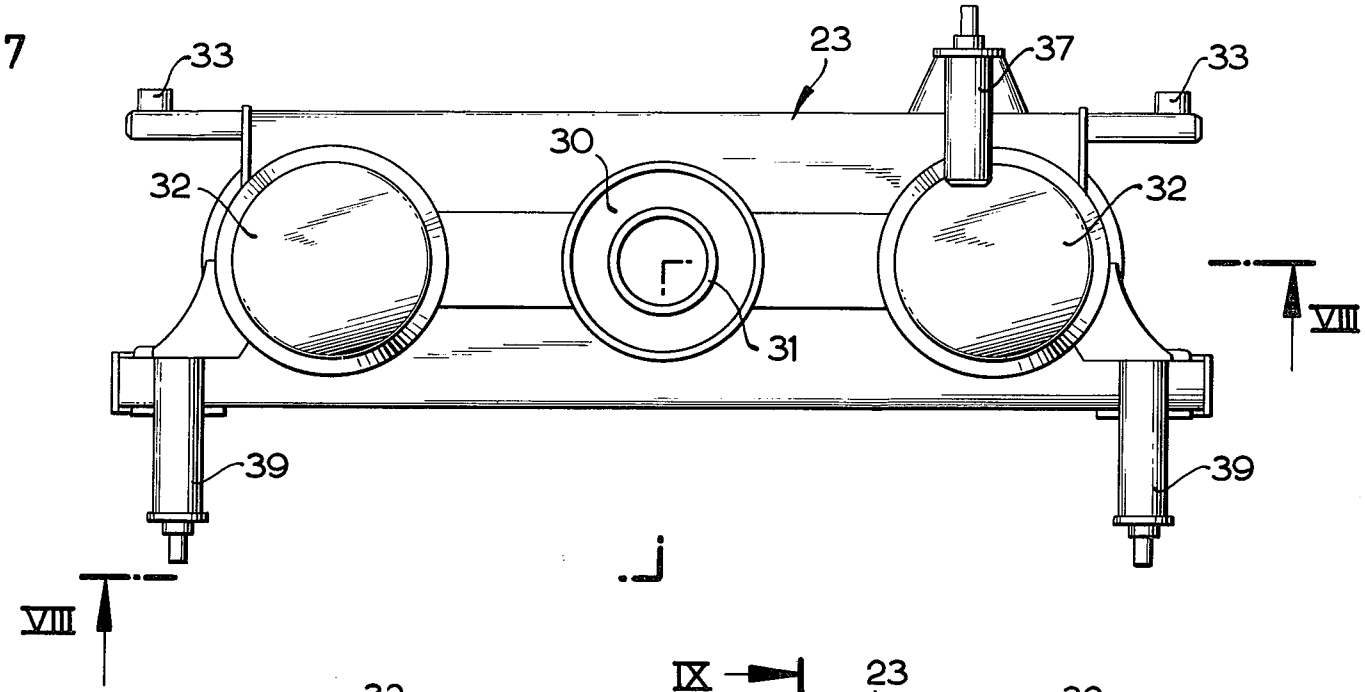
FIG. 7 is a top view of the cradle frame of the swivel truck of the invention.
Figure 8:
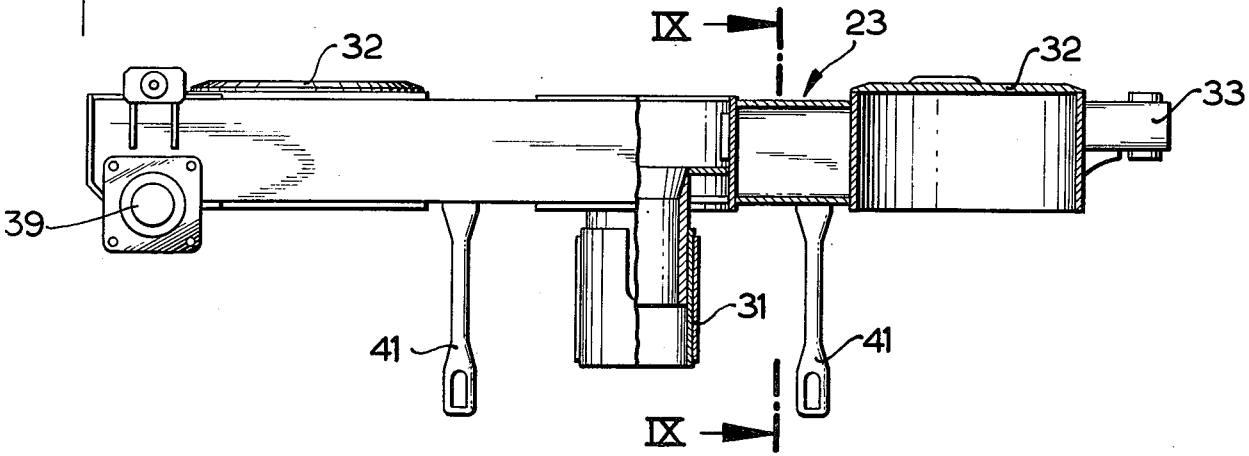
FIG. 8 is a front view of the cradle frame according to FIG. 7 taken along the line VIII—VIII

Referring to FIG. 10 there is therein shown one of the spring systems of the invention. Each of these spring systems is a spring assembly comprising an outer coil spring 25 and an inner coil spring 26. The upper ends of the two coil springs rest against a helical spring plate 27. Between this spring plate 27 and the cradle frame 23 there is inserted an elastic block 28 for sound-proofing. Inside of the coil springs there is a supplementary rubber spring 29 with a strongly progressive characteristic. This progressiveness allows the natural inherent frequency of the springing to remain rather constant during all loading conditions. At maximum springing, the additional spring is vertically so stiff that it acts as a stop. The cradle frame 23, shown in FIGS. 7 to 9, is a torsion stiff box carrier which has in the center around opening 30 to which a cylindrical projection 31 is connected for mounting of the main journal bearing arranged on the car vehicle box (not shown). The round mountings 32 are arranged on either side for the pair of spring systems. In addition, on the cradle frame bearing 33 there is a torsion rod for the sway stabilizing system and holders 37 for horizontal buffers 38 (FIG. 2). There is also disposed on the cradle frame holders 39 for vertical buffers 40 (FIG. 2) and flange flaps 41 (FIG. 8) for the mounting of lifting safeguards for the cradle frame.

A swivel support is provided so that the car body cannot tilt too far to one side when the vehicle is negotiating a curve or during one-sided loading of the car body. This swivel support comprises a torsion rod 34 (FIG. 3) rotatably mounted on the cradle frame in bearings 33, of horizontal arms 35 mounted non-rotatably at the ends of the torsion rod and the vertical rods 36 connecting the free ends of arms 35 with the extension pieces 21 of the stiffening sheet 8. This swivel support does not prevent the springing of the cradle frame against the swivel truck since thereby the two arms 35 carry out a rotation in the same direction around the axle of the torsion rod 34. However, if the car body moves to the side, the two levers 35 move in the opposite direction and thereby the torsion rod 34 is twisted in itself and produces an elastic counterforce against the tilting of the car body. The horizontal mufflers 38 and the vertical mufflers 40 serve to absorb movements of the car bodies.

The driving motors 42 and 43 are disposed in the swivel truck in such a manner that their axles lie parallel to the wheel axles 11 and 12. The crankshaft housings are suspended at 44 on the cross members and at 45 on the longitudinal members. The start of the wheel axles takes place over a spur gear system 46, 47.

A magnetic rail brake 65 is suspended from the truck. Magnetic rail brakes will act only when they are close to the top of the rail at the moment when braking begins. In swivel trucks with spring-mounted axles, however, the height of the swivel truck frame above the top of the rail is maximally controlled by the loading of the vehicle, so that special adjusting devices are needed in order to assure that the magnetic rail brake will always be quite close to the top of the rail and both sides of the truck, even when vehicle loading and position at equilibrium vary. In the swivel truck of the invention, the height of the truck frame above the rail edge hardly varies at all on account of axle springing. It is, therefore, possible to suspend the magnetic rail brake 65 directly from the truck frame by means of a manually adjustable hanger 66. However, in this case the suspension is preferably done on the lateral arms 15 of the axle bearing housings on the hooks 67 (FIG. 11), so that there is no influence of the spring deflections upon the height of the magnetic rail brake over the rail top edge.

Figure 12:
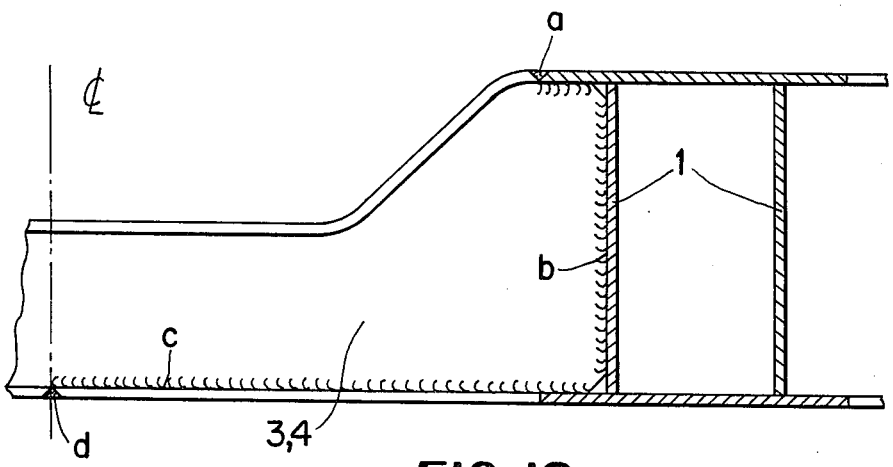
FIG. 12 shows an enlarged simplified detailed view of the view of FIG. 6.

Referring to FIG. 12, there is shown an enlarged detail view of FIG. 6 in which:

*a* is a welding seam upper flange of longitudinal member 1 having upper flange longitudinal members 3 and 4;

*b* is a welding seam cross bar-cross member with the one side wall of the longitudinal member 1 formed at this spot in the manner of a box girder;

*c* is a welding seam cross bar having lower flange cross bars 3 and 4;

*d* is a welding seam disposed between the right portion and the left portion of the lower flange of cross member 3, 4.

Figure 13:
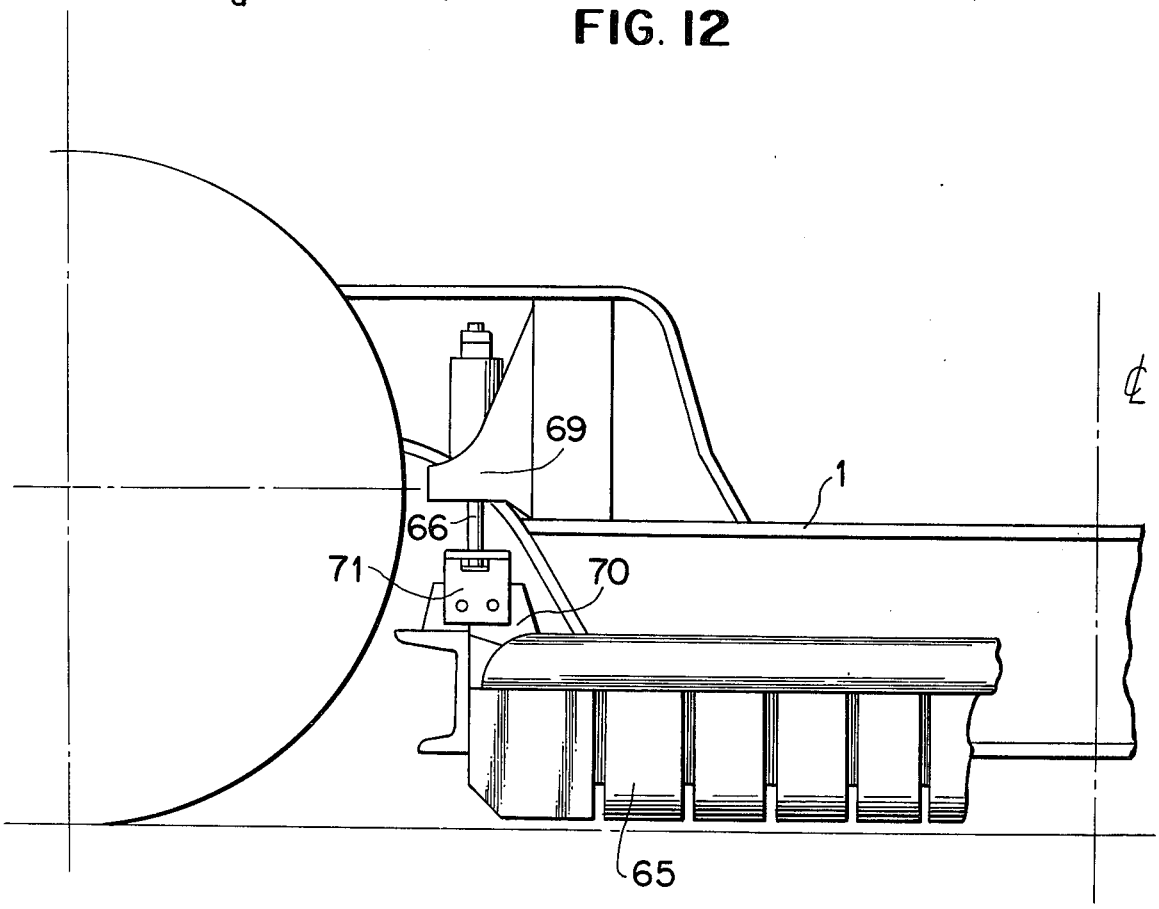
FIG. 13 is an enlarged simplified detailed view of FIG. 2.

Referring to FIG. 13 there is shown one of four brackets 69 which are welded to the longitudinal members 1. The rail brake 65 is divided at each end with a suspension plate 70 which is screwed with a suspension plate 71 to the hanging arrangement 66.

WHAT IS CLAIMED IS:

1. A motor powered swivel truck for rail vehicles, especially for streetcars, comprising a welded swivel truck frame having a pair of wheel axles, a cradle frame, a spring system and a sway stabilizing means A. Said swivel truck frame comprising two longitudinal members, the middle portion of each being disposed at a level below the end portions thereof and having an open profile, the end portions thereof having a closed profile, a pair of cross members welded to said longitudinal member within the wheel axles to define a quadrangle where the middle portions of the longitudinal members have the lower leve, said longitudinal members having an upper flange extending laterally thereof and running longitudinally, said flange being bent downwardly, said cross members having a laterally extending lower flange, said cross members being welded to the upper flange of the middle portion of said longitudinal members within said quadrangle through a stiffening sheet, said stiffening sheet being welded to said upper and lower flanges;

B. The end portions of said longitudinal members having recesses for receiving wheel bearings;

C. Said spring system disposed between said swivel truck frame and said cradle frame and comprising a pair of coil springs, one on each side of said truck;

D. Said sway stabilizing means comprising a torsion rod disposed rotatably at said cradle frame transversely of the direction of travel of said truck, the ends of which are connected to horizontally disposed levers rigidly mounted, said horizontally disposed levers each having a free end, said free ends each connected to a vertical member, said vertical member connected to said swivel truck frame;

E. Said cradle frame comprising a central receiver for receiving a connector attached to a car body, a pair of electric motors having output shafts, said motor disposed on said cradle such that said output shafts are parallel to the wheel axles, the housings for said motor suspended on one side on a longitudinal member.

2. A motor powered swivel truck according to claim 1, wherein the ends of the cross members extending outwardly beyond the longitudinal members have a closed profile.

3. A motor powered swivel truck according to claim 1 wherein between each of the coil springs and the cradle frame there is a block of rubber-elastic material.

4. A motor powered swivel truck according to claim 1 wherein each coil spring is steel and there is a supplementary spring of rubber-elastic plastic disposed between said swivel truck frame and said cradle frame within said spring having a height shorter than the normal, relaxed height of said coil spring.

5. A motor powered swivel truck for rail vehicles according to claim 1 wherein a magnetic rail brake is suspended directly from the swivel truck.

6. A motor powered swivel truck for rail vehicles, especially for streetcars, comprising a welded swivel truck frame having a pair of wheel axles, a cradle frame, a spring system and a sway stabilizing means A. Said swivel frame comprising two longitudinal members, the end portions of which have a closed profile and lie at a higher level than the middle portion, said middle portion having an open profile, a pair of cross members welded to said longitudinal members to define a quadrangle where the middle portions of said longitudinal members have the lower level, said longitudinal members having an upper flange extending laterally and running longitudinal thereof, said upper flange being bent downwardly, said cross members having a lower laterally extending flange, said upper flange of said longitudinal member being welded to said lower flange of said cross member at the point at which said upper flange is bent downwardly through a stiffening sheet disposed within said quadrangle, said stiffening sheet being welded to said upper and lower flanges;

B. The end portions of said longitudinal member having recesses for receiving wheel bearings;

C. Said spring system disposed between said swivel truck frame and said cradle frame and comprising a pair of coil springs, one on each side of said truck and disposed within each of said springs a supplementary spring of rubber-elastic material, and disposed within each of said coil springs and between said cradle frame and said swivel truck frame a block of rubber-elastic material having a height less than the normal relaxed height of said coil springs;

D. Said sway stabilizing means comprising a torsion rod disposed rotatably at said cradle frame transversely of the direction of travel of said truck the ends of which are connected to horizontally disposed levers rigidly mounted, said horizontally disposed levers each having a free end, said free ends each connected to a vertical member, said vertical member connected to said swivel truck frame;

E. Said cradle frame having a central receiver for receiving a connector attached to a car body, a pair of motors having output shafts, the housings for said motors suspended on one side from a longitudinal member.

7. A motor powered swivel truck for rail vehicles, especially for streetcars, comprising a welded swivel truck frame, a cradle frame, a spring system and a sway stabilizing means A. Said swivel frame comprising two longitudinal members, the end portions of which have a closed profile and lie at a higher level than the middle portion, said middle portion having an open profile, a pair of cross members welded to said longitudinal members to define a quadrangle where the middle portions of said longitudinal members have the lower level, said longitudinal members having an upper flange extending laterally and running longitudinal thereof, said upper flange being bent downwardly, said cross members having a lower laterally extending flange, said upper flange of said longitudinal member being welded to said lower flange of said cross member at the point at which said upper flange is bent downwardly through a stiffening sheet disposed within said quadrangle and welded to said upper and lower flanges;

B. The end portions of said longitudinal member having recesses for receiving wheel bearings; the end portions of said longitudinal members being shaped in their upper parts as box girders, each of said recesses accomodating a wheel set bearing including a bearing and a housing therefore, each of said wheel set bearings having two lateral arms on which the end of the longitudinal members is supported;

C. Said spring systems comprising a pair of coil springs disposed between said swivel truck frame and said cradle frame;

D. Said sway stabilizing means comprising a torsion rod disposed rotatably at said cradle frame transversely of the direction of travel of said truck, the ends of which are connected to horizontally disposed levers rigidly mounted, said horizontally disposed levers each having a free end, said free ends each connected to a vertical member, said vertical member connected to said swivel truck frame;

E. Said cradle frame comprising a central receiver for receiving a connector attached to a car body, a pair of electric motors having output shafts, said motor disposed on said cradle from such that said output shafts are parallel to the wheel axles the housings for said motor suspended on one side on a longitudinal member.

8. A motor powered swivel truck for rail vehicles, especially for streetcars, comprising a welded swivel truck frame, a cradle frame, a spring system and a swivel stabilizing means and a pair of electric motors wherein:

A. Said swivel truck frame comprises a pair of longitudinal members each of which has end portions having a closed profile, each of which longitudinal members has a middle portion, said end portions disposed at a level higher than said middle portions, a pair of cross members welded to said longitudinal member at the point at which said end portions of said longitudinal members begin to form into the middle portion to define a quadrangle, said cross members having an upper flange between said longitudinal members which is bent downwardly, said cross members having a generally I-shaped profile between said longitudinal members, said longitudinal members having laterally extending upper flanges welded to lower edges of the flange and said I profiles, by a stiffening member disposed within said quadrangle and welded to said upper and lower flanges;

B. The end portions of said longitudinal member having recesses for receiving wheel bearings;

C. Said spring system comprising a coil spring on each side of said truck disposed between said swivel truck frame and said cradle frame;

D. Said sway stabilizing means comprising a torsion rod disposed rotatably at said cradle frame transversely of the direction of travel of said truck, the ends of which are connected to horizontally disposed levers rigidly mounted, said horizontally disposed levers each having a free end, said free ends each connected to a vertical member, said vertical member connected to said swivel truck frame;

E. Said cradle frame comprising a central receiver for receiving a connector attached to a car body, a pair of electric motors having output shafts, said motor disposed on said cradle such that said output shafts are parallel to the wheel axles, the housings for said motor suspended on one side on a longitudinal member.

* * * * *

UNITED STATES PATENT AND TRADEMARK OFFICE

CERTIFICATE OF CORRECTION

PATENT NO. :4,046,080

DATED : Sept. 6, 1977

INVENTOR(S) : Hans Dieling et al

It is certified that error appears in the above-identified patent and that said Letters Patent are hereby corrected as shown below:

| | |
|---|---|
| Title Page-Inventors | "Rhunda" should be--Rhünda-- |
| Col. 4, line 33 | "p" in "pletely" obliterated |
| Col. 6, line 9 | "leve" should be--level-- |
| Col. 8, line 39 | Before "said" change "and" to --of-- |

Signed and Sealed this

*Fourth* Day of *April 1978*

[SEAL]

*Attest:*

RUTH C. MASON
*Attesting Officer*

LUTRELLE F. PARKER
*Acting Commissioner of Patents and Trademarks*